US005666843A

United States Patent [19]

Müller

[11] Patent Number: 5,666,843

[45] Date of Patent: Sep. 16, 1997

[54] LIGHT SECTION ROLLING MILL PARTICULARLY WIRE ROLLING MILL

[75] Inventor: Alfred Müller, Krefeld, Germany

[73] Assignee: SMS Schloemann-Siemag Aktiengesellschaft, Düsseldorf, Germany

[21] Appl. No.: 508,917

[22] Filed: Jul. 28, 1995

[30] Foreign Application Priority Data

Jul. 29, 1994 [DE] Germany ..... 44 26 930.7

[51] Int. Cl.[6] ..... B21B 31/02

[52] U.S. Cl. ..... 72/234

[58] Field of Search ..... 72/228, 234, 235, 72/237

[56] References Cited

U.S. PATENT DOCUMENTS 3,220,293 11/1965 Barber .

4,182,148 1/1980 Gilvar ..... 72/228

5,406,822 4/1995 Keller et al. ..... 72/234

FOREIGN PATENT DOCUMENTS 0560115 2/1993 European Pat. Off. .

622505 11/1935 Germany .

2902788 8/1980 Germany .

*Primary Examiner*—Lowell A. Larson

*Assistant Examiner*—Thomas C. Schoeffler

*Attorney, Agent, or Firm*—Friedrich Kueffner

[57] ABSTRACT

In a light section rolling mill, particularly wire rolling mill, for optimizing the product quality and/or output of the finishing train, at least one standard two-stand roughing block or group is arranged in front of and/or following the finishing train. Standard two-stand roughing blocks can be combined into roughing block units having four stands, six stands, eight stands or ten stands, and these units can be arranged in front of and/or following the finishing train.

3 Claims, 2 Drawing Sheets

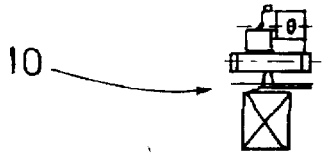
FIG.1
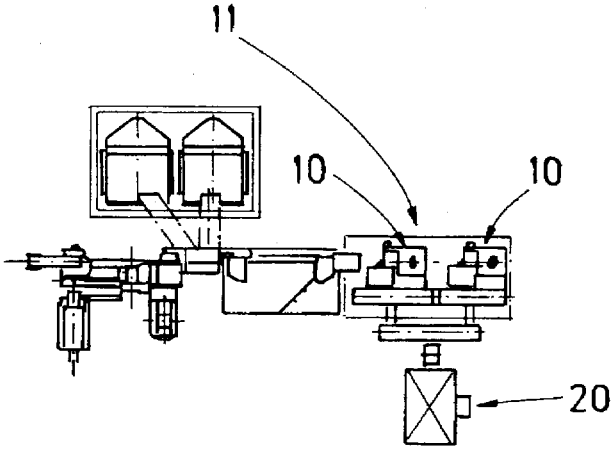
FIG.2
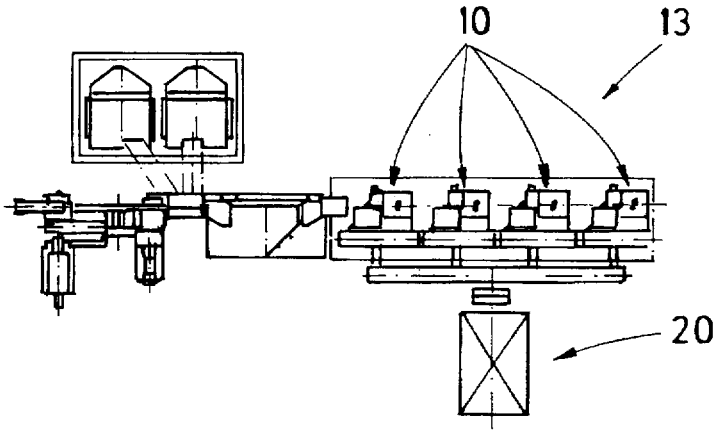
FIG. 3
FIG.4
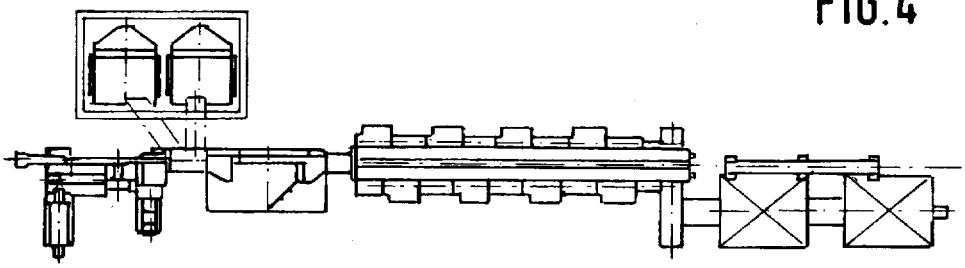

LIGHT SECTION ROLLING MILL PARTICULARLY WIRE ROLLING MILL

BACKGROUND OF THE INVENTION

1. Field of the Invention

The present invention relates to a light section rolling mill, particularly wire rolling mill, for optimizing the product quality and/or output of the finishing train.

2. Description of the Related Art

In older light section rolling mills, particularly wire rolling mills, it is frequently necessary to modernize and/or increase the output of the existing finishing train by modification and/or expansion. This is particularly true for finishing trains equipped with older roll stands which are no longer capable of keeping up with the increased requirements with respect to quality and/or productivity of modern plants. This is also particularly true when, in addition to the existing rolling schedule, an increase with respect to quantity and/or quality appears desirable for economical reasons and when the existing rolling plant is not sufficient for achieving this increase.

However, it would not be advantageous for economical reasons to replace the entire existing finishing train by a new plant because the costs incurred by this replacement are not economically balanced with the production increase to be expected.

SUMMARY OF THE INVENTION

Therefore, it is the primary object of the present invention to provide a light section rolling mill or wire rolling mill for optimizing the product quality and/or output of the finishing train in which an increase of the product quality and/or output of the finishing train is possible and/or an expansion of the production schedule can be achieved in a manner which is as inexpensive as possible, requires as little space as possible and causes little interruption of the production as a result of the modification.

In accordance with the present invention, the above object is met in a light section rolling mill or wire rolling mill by arranging at least one standard two-stand roughing block or group in front of and/or following the finishing train.

The two-stand plant portion called standard roughing block hereinabove is a perfected and proved basic element in the form of a building block or component, wherein this basic element can be combined into a multiple piece unit, for example, by arranging several such building blocks in a row, and wherein the basic element can be expanded without adaptation problems into a wire finishing train with any selected number of stands.

For example, a single basic building block can be arranged following the finishing train for carrying out a readjustment of the tolerances of a wire dimension. Also, when the operation of older stands in a finishing train is temporarily interrupted, for example, due to repairs, the missing rolling capacity can then be compensated by arranging one or more standard roughing blocks in front of or following the finishing train.

Consequently, the variable use of two-stand standard roughing blocks in an arrangement according to the building block principle provides a number of inexpensive and quickly manageable possibilities for maintaining the output, for increasing the output and/or for increasing the quality of an existing finishing train.

In accordance with a further development of the invention, standard two-stand roughing blocks can be combined into roughing block units having four stands, six stands, eight stands or ten stands, and these units can be arranged in front of and/or following the finishing train.

In accordance with another further development, stands of the finishing train which have become ineffective, for example, because of repairs, are replaced by at least one standard roughing block.

In accordance with another embodiment of the present invention, a finishing train is bypassed by a number of two-stand standard roughing blocks which are combined into a finishing block. This makes it possible, for example, to roll a different wire dimension in the plant portion which bypasses the finishing train than in the plant portion with the existing finishing train.

Accordingly, a light section rolling mill or wire rolling mill according to the present invention has at least one standard roughing block arranged in front of or following the finishing train and/or standard roughing blocks which bypass the finishing train. Such a set of standard roughing blocks for modification or expansion can be used in a surprisingly uncomplicated manner in accordance with the building block principle and can be integrated in the finishing train.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is a schematic top view of a standard two-stand roughing block used according to the present invention;

FIG. 2 is a schematic top view of two two-stand roughing blocks which are combined into a unit;

FIG. 3 is a schematic top view of four two-stand standard roughing blocks which are combined into a unit;

FIG. 4 is a schematic top view of a conventional finishing block unit of an eight-stand wire rolling train constructed in accordance with the building block principle.

DESCRIPTION OF THE PREFERRED EMBODIMENTS

Figure 5:
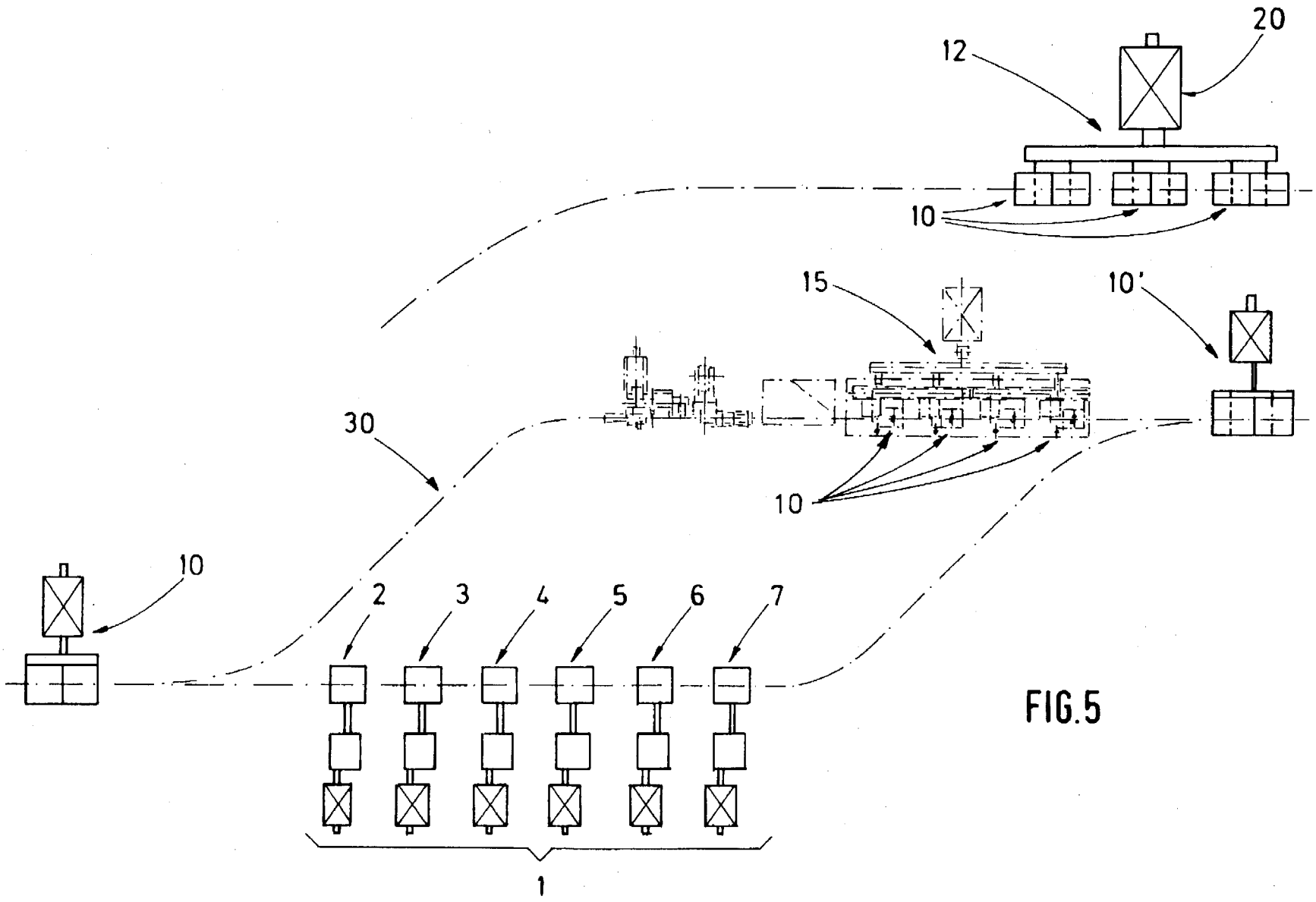
FIG. 5 is a schematic illustration in the manner of a flow diagram of a production plant for rolling light steel sections, particularly wire dimensions.

FIG. 1 of the drawing shows a single two-stand roughing block 10 which can be combined as desired with other blocks. As illustrated in FIG. 5, the roughing block 10 can be arranged in front of or following an existing finishing train 1.

FIG. 2 of the drawing shows a four-stand unit 11 which is composed of two two-stand standard roughing blocks 10. The roughing blocks 10 are connected to each other by a common drive unit 20.

An eight-stand wire roughing block unit 13 is shown in FIG. 3. This unit 13 is composed of four standard roughing blocks 10 which arranged in the manner of building blocks and have a common drive 20.

FIGS. 2 and 3 of the drawing show uncomplicated combination possibilities of multiple-stand units by using standard roughing blocks 10 as the basic building blocks. The number of such basic building blocks 10 can be selected as desired.

In this manner, by arranging roughing blocks in a row to form finishing blocks, it is possible to put together four-stand, six-stand, eight-stand and even ten-stand plant portions and to use these plant portions to supplement or further expand existing plant portions.

In contrast to the arrangement of individual standard roughing blocks in a row in the manner of building blocks, FIG. 4 shows the construction of a conventional finishing block in accordance with the prior art. It is apparent that, in contrast to the arrangements of standard roughing blocks in a row in accordance with the building block principle as shown in FIGS. 2 and 3, a quick modification of the conventional finishing blocks shown in FIG. 4 is not easily possible.

FIG. 5 of the drawing shows in a schematic diagram a production plant for light section steel products, particularly for wire dimensions. The plant has as its basic equipment the finishing train 1 with six individual stands 2 through 7. In accordance with the present invention, a two-stand roughing block 10 is arranged in front of the finishing train 1 for increasing the productivity of the plant or for replacing a stand which has been made inoperative. If desired, a two-stand roughing block 10' may be arranged following the finishing train 1 for achieving the same purpose and/or for the recalibration of rolling stock.

In the case of a production increase and/or for replacing stands 2 to 7 which have become inoperative or require repair, instead of the two-stand roughing block 10', a multiple-stand unit, for example, a six-stand combination 12, can be arranged following the finishing train 1. In accordance with the illustrated embodiment, the combination 12 may be composed of three two-stand basic building blocks 10 with a common drive 20. The number of building blocks 10 used in a unit depends on the existing requirements.

Another possibility of increasing the output and quality of an existing finishing train 1 is to provide a finishing block unit 15 which, for example, bypasses the finishing train 1. In accordance with the example illustrated in FIG. 5, the finishing block unit 15 can be composed of four two-stand roughing blocks 10. The number of roughing blocks depends on the rolling schedule. This finishing block unit 15 makes possible an advantageous adaptation in the building block system to special requirements and provides the possibility of rolling other wire dimensions or other material qualities in the bypassing loop 30, while standard qualities continue to be rolled in the existing finishing train 1.

Thus, the present invention makes possible an extremely flexible expansion or modification of an existing finishing train 1 for light section steel or wire dimensions by providing additional individual standard roughing blocks 10 to 13 or combinations of standard roughing blocks 10 to 13 in front of or following the finishing train 1 and provides the surprisingly problem-free possibility of expanding and improving an existing rolling plant while requiring relatively small costs and a relatively small space, wherein the modification or expansion can be carried out with acceptably short interruptions of the operation of the rolling plant.

While specific embodiments of the invention have been shown and described in detail to illustrate the inventive principles, it will be understood that the invention may be embodied otherwise without departing from such principles.

I claim:

1. In a light section rolling mill including means for optimizing product quality and/or output of a finishing train, the improvement comprising the means of the finishing train comprising variably usable mill components in the form of standard two-stand roughing blocks, wherein each standard two-stand roughing block comprises a basic element in the form of a building block, and wherein a plurality of building blocks of identical construction are configured to be arranged in a sequence to form a multiple-stand unit with any selected numbers of stands of the finishing train.

2. The light section rolling mill according to claim 1, comprising a finishing block composed of a plurality of standard two-stand roughing blocks, the finishing block being mounted so as to bypass the finishing train.

3. The light section rolling mill according to claim 1, wherein the finishing train comprises variably usable mill components in an arrangement according to a building block principle, comprising one of a single-stand unit or multiple-stand unit of standard roughing blocks, further comprising a common drive for the blocks.

* * * * *